US010245523B2

(12) United States Patent
Lin

(10) Patent No.: US 10,245,523 B2
(45) Date of Patent: Apr. 2, 2019

(54) MAGNETIC BUILDING BLOCK

(71) Applicant: SHANTOU XINBIDA EARLY EDUCATION TECHNOLOGY CO., LTD., Shantou, Guangdong (CN)

(72) Inventor: Yiqun Lin, Guangdong (CN)

(73) Assignee: Shantou Xinbida Early Education Technology Co., Ltd., Guangdong (CN)

( * ) Notice: Subject to any disclaimer, the term of this patent is extended or adjusted under 35 U.S.C. 154(b) by 0 days.

(21) Appl. No.: 15/650,326

(22) Filed: Jul. 14, 2017

(65) Prior Publication Data

US 2018/0333652 A1 Nov. 22, 2018

(30) Foreign Application Priority Data

May 17, 2017 (CN) ..... 2017 2 0549148 U

(51) Int. Cl.
*A63H 33/04* (2006.01)
*A63H 33/26* (2006.01)
*A63H 33/06* (2006.01)

(52) U.S. Cl.
CPC ..... *A63H 33/046* (2013.01); *A63H 33/06* (2013.01); *A63H 33/26* (2013.01)

(58) Field of Classification Search
CPC ..... A63H 33/04; A63H 33/044; A63H 33/046
See application file for complete search history.

(56) References Cited

U.S. PATENT DOCUMENTS 8,458,863 B2 * 6/2013 Hunts ..... H01F 7/0242 24/303
9,713,777 B2 * 7/2017 Peterson ..... A63H 33/046
2004/0102131 A1 * 5/2004 Orlowski ..... A63H 33/18 446/46
2013/0267145 A1 * 10/2013 Rosen ..... A63H 33/046 446/92
2014/0179194 A1 * 6/2014 Fein ..... A63H 33/046 446/92
2015/0072587 A1 * 3/2015 Ornstein ..... A63H 33/046 446/92
2015/0231521 A1 * 8/2015 Peterson ..... A63H 33/046 446/92
2016/0074766 A1 * 3/2016 Choi ..... A63H 33/046 446/92

(Continued)

*Primary Examiner* — Eugene L Kim
*Assistant Examiner* — Alyssa M Hylinski
(74) *Attorney, Agent, or Firm* — Muncy, Geissler, Olds & Lowe, P.C.

(57) ABSTRACT

The present utility model provides a magnetic building block. A building block back side is installed on a rear end of a building block front side. Four notches are formed on both of the rear end of the building block front side and a front end of the building block back side. Four protruding chucks are formed on both of the rear end of the building block front side rear end and the front end of the building block back side. Four small magnets are disposed on the front end of the building block back side. The protruding chuck and the notch are disposed on two sides of the small magnet. An embedded paper is disposed between the building block front side and the building block back side. The embedded paper is inlaid in a rectangle surrounded by the notch, the small magnet, and the protruding chuck.

9 Claims, 4 Drawing Sheets

(56) References Cited

U.S. PATENT DOCUMENTS

| | | | | |
|---|---|---|---|---|
| 2016/0102131 | A1* | 4/2016 | Li | C12N 15/85<br>435/461 |
| 2016/0184727 | A1* | 6/2016 | Ornstein | A63H 33/046<br>446/92 |
| 2017/0182429 | A1* | 6/2017 | Choi | A63H 33/046 |

* cited by examiner

MAGNETIC BUILDING BLOCK

FIELD OF THE UTILITY MODEL

The present utility model is a magnetic building block, and belongs to the field of toy equipment.

BACKGROUND OF THE UTILITY MODEL

Building blocks are usually cubic wooden or plastic solid toys, each surface of which is generally decorated with letters or pictures. The building blocks may be arranged in different ways or used to play a construction activity. The building blocks have diversified shapes, may develop intelligence of children, and may be assembled into houses, animals, and the like. The building blocks help in intelligence development and hand-eye coordination training of children. The arrangement, connection, annulus, symmetry, and the like during playing with the building blocks are all helpful to the intelligence of children. When stacking up the building blocks, children surely encounter problems such as scale and symmetry, which helps in early training of children in the number concept.

Existing building blocks are mostly of cuboids, whose shapes are fixed and lack diversity. Children mainly play with such building blocks, and lose interest in the existing building blocks. The existing building blocks easily fall down when stacked up, which is not safe to young children. The surface of the existing building blocks lacks decorative patterns or other things that can attract attention of children, and naturally, children do not want to play. Besides, the existing building blocks are mostly angular, posing a safety threat to children during play.

SUMMARY OF THE UTILITY MODEL

In view of disadvantages of the prior art, the objective of the present utility model is to provide a magnetic building block, to resolve the problems mentioned in the background. The present utility model is convenient to use, and easy to operate, has good stability, and is safe and reliable, cute and interesting, and easy to maintain.

To achieve the foregoing objective, the present utility model is implemented by using the following technical solution: A magnetic building block comprises: a building block front side, a building block back side, a notch, a small magnet, a protruding chuck, an embedded paper, reinforcing ribs, and a silicone protective ring. Four small magnets are disposed. The building block back side is installed on a rear end of the building block front side. Four notches are formed on both of the rear end of the building block front side and a front end of the building block back side. Four protruding chucks are disposed on both of the rear end of the building block front side and the front end of the building block back side. The four small magnets are disposed on the front end of the building block back side. The protruding chuck and the notch are installed on two sides of the small magnet. The embedded paper is disposed between the building block front side and the building block back side. The embedded paper is inlaid in a rectangle surrounded by the notch, the small magnet, and the protruding chuck. The reinforcing ribs are distributed on inner walls of the building block front side and the building block back side. The silicone protective ring is located on outer side faces of the building block front side and the building block back side.

Further, the building block front side and the building block back side are in a same structure.

Further, the building block front side is square.

Further, a groove is formed on an inner end of the building block front side, and the small magnet is installed in the groove.

Further, the building block front side and the building block back side are engaged by using the notch and the protruding chuck.

Further, edges and corners of the building block front side and the building block back side are chamfered.

Further, skidproof stripes are distributed on an outer side face of the silicone protective cover.

Further, different patterns are distributed on the embedded paper.

Beneficial effects of the present utility model are as follows: The present utility model provides a magnetic building block. According to the present utility model, a building block front side, a building block back side, a notch, a small magnet, a protruding chuck, and an embedded paper are added. With such a design, the building block is convenient to detach and easy to maintain, stability of connection between building blocks is enhanced, the building block is lighter, materials are reduced and are energy saving and environmentally friendly, and it is not easy to break into pieces, thereby protecting people from getting injured. This resolves the following disadvantages of existing building blocks: Repair is difficult after damage. The building blocks easily fall down when stacked up, and hit children. The building blocks are heavy, making it inconvenient for children to play, and causing waste of materials. The shape of the building blocks lacks diversity. The building blocks injure children when broken.

A groove is added, and the small magnet may be fixed with such a design. Rounded corners are added, and such a design can protect children from getting scratched by a right angle on the building block. The present utility model is convenient to use, and easy to operate, has good stability, and is safe and reliable, cute and interesting, and easy to maintain.

BRIEF DESCRIPTION OF THE DRAWINGS

Additional features, objectives, and advantages of the present utility model will become more apparent upon reading detailed descriptions of non-limitative embodiments with referent to the accompanying drawings.

In the Figures: 1: Building block front side, 2: Building block back side, 3: Notch, 4: Small magnet, 5: Protruding chuck, 6: Embedded paper, 7: Reinforcing rib, and 8: Silicone protective ring.

DETAILED DESCRIPTION OF THE UTILITY MODEL

To make the technical means used to implement the present utility model, creation features, and achieved objectives and effects comprehensive, the present utility model is further described below by using specific implementations.

Figure 1:
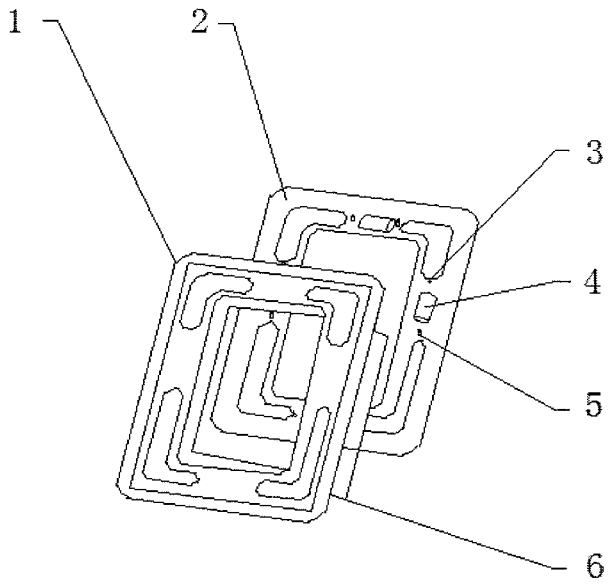
FIG. 1 is a schematic structural diagram of a magnetic building block according to the present utility model.
Figure 2:
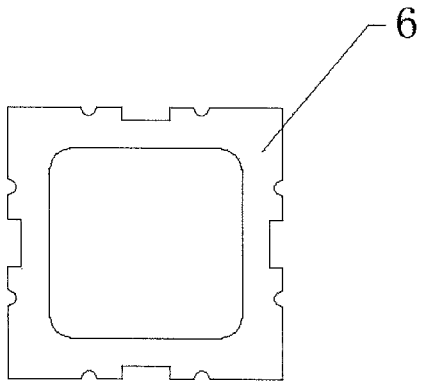
FIG. 2 is a schematic diagram of an embedded paper in the magnetic building block according to the present utility model.
Figure 3:
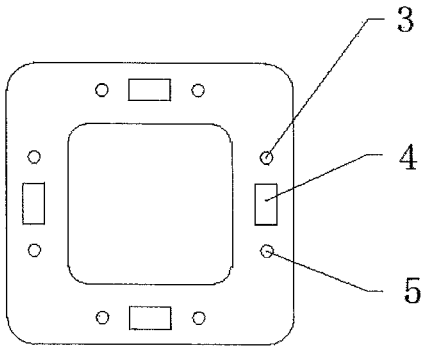
FIG. 3 is a main view of a building block back side of the magnetic building block according to the present utility model.
Figure 4:
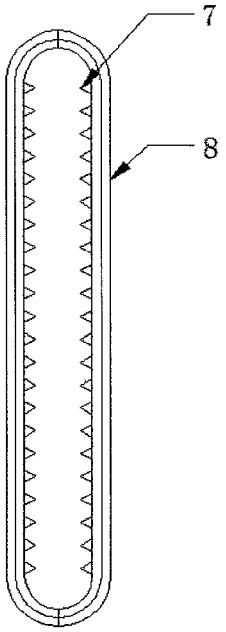
FIG. 4 is a schematic distribution diagram of reinforcing ribs in the magnetic building block according to the present utility model.

Referring to FIGS. 1 to 4, the present utility model provides a technical solution: A magnetic building block comprises: a building block front side 1, a building block back side 2, a notch 3, a small magnet 4, a protruding chuck 5, an embedded paper 6, reinforcing ribs 7, and a silicone protective ring 8. Four small magnets 4 are disposed. The building block back side 2 is installed on a rear end of the building block front side 1. Four notches 3 are formed on both of the rear end of the building block front side 1 and a front end of the building block back side 2. Four protruding chucks 5 are disposed on both of the rear end of the building block front side 1 and the front end of the building block back side 2. The four small magnets 4 are disposed on the front end of the building block back side 2. The protruding chuck 5 and the notch 3 are installed on two sides of the small magnet 4. The embedded paper 6 is disposed between the building block front side 1 and the building block back side 2. The embedded paper 6 is inlaid in a rectangle surrounded by the notch 3, the small magnet 4, and the protruding chuck 5. The reinforcing ribs 7 are distributed on inner walls of the building block front side 1 and the building block back side 2. The silicone protective ring 8 is located on outer side faces of the building block front side 1 and the building block back side 2.

The building block front side 1 and the building block back side 2 are in a same structure. The building block front side 1 is square. A groove is formed on an inner end of the building block front side 1, and the small magnet 4 is installed in the groove. The building block front side 1 and the building block back side 2 are engaged by using the notch 3 and the protruding chuck 5. Edges and corners of the building block front side 1 and the building block back side 2 are chamfered. Skidproof stripes are distributed on an outer side face of the silicone protective cover. Different patterns are distributed on the embedded paper. In this way, the embedded paper 6 may be switched to a different pattern according to preference of children.

During specific implementation, when the present utility model is used, a user first assemblies the present utility model. First, the building block back side 2 and the small magnet 4 are fetched. Then the small magnet 4 is placed in the groove in the building block back side 2. Then one embedded paper 6 is fetched, and inlaid in the building block back side 2. Then the building block front side 1 is fetched. Because the building block front side 1 and the building block back side 2 are engaged by using the notch 3 and the protruding chuck 5, the building block front side 1 is installed on the front end of the building block back side 2. The design makes it convenient to detach and maintain the building block.

After the present utility model is assembled, children may select multiple present utility models, and fasten a building block front side 1 of one present utility model onto a building block back side 2 of another present utility model by using the small magnet 4. The present utility models may be stacked up by repeating this action. The design makes it convenient to operate, and is safe and reliable.

The foregoing displays and describes the basic principle and main features and advantages of the present utility model. A person skilled in the art should understand that the foregoing exemplary embodiments apparently do not limit the present utility model, and the present utility model may be implemented in another specific form without departing from the spirit or basic features of the present utility model. Therefore, the embodiments should always be considered exemplary and non-limitative. The scope of the present utility model shall be subject to the appended claims rather than the specification. Therefore, all changes made within the meaning and scope of the equivalent of the claims shall be encompassed in the present utility model. The reference numerals in the claims should not be considered as any limitation to the concerned claims.

In addition, it should be understood that the specification is described by using implementations, but not all implementations each include only one independent technical solution. The descriptions in the specification are merely for clarification, and persons skilled in the art should consider the specification as a whole, and the technical solutions in the embodiments may be properly combined to form other implementations that can be understood by persons skilled in the art.

The invention claimed is:

1. A magnetic building block, comprising:

a building block front side having a center opening;

a building block back side installed on a rear end of the building block front side and having a center opening;

four notches formed on both of the rear end of the building block front side and a front end of the building block back side;

four small magnets disposed on the front end of the building block back side;

four protruding chucks disposed on both of the rear end of the building block front side and the front end of the building block back side;

an embedded paper disposed between the building block front side and the building block back side and surrounded by the notches, the small magnets and the protruding chucks;

reinforcing ribs distributed on inner walls of the building block front side and the building block back side; and a silicone protective ring located on outer side faces of the building block front side and the building block back side, wherein the protruding chucks and the notches on each of the front and back sides are installed such that the front and back sides each provide a protruding chuck and a notch positioned on opposite sides of each of the four small magnets, and wherein the embedded paper has a shape conforming to a shape of the building block front side and the building block back side and has a center opening aligned with the center opening of the building block front side and the center opening of the building block back side.

2. The magnetic building block according to claim 1, wherein the building block front side and the building block back side have the same structure.

3. The magnetic building block according to claim 1, wherein the building block front side is square.

4. The magnetic building block according to claim 1, further comprising a plurality of grooves formed on the rear end of the building block front side wherein each of the small magnets is installed in a respective one of the plurality of grooves.

5. The magnetic building block according to claim 1, wherein the building block front side and the building block back side are engaged using the notches and the protruding chucks.

6. The magnetic building block according to claim 1, wherein edges and corners of the building block front side and the building block back side are chamfered.

7. The magnetic building block according to claim 1, wherein skidproof stripes are distributed on an outer side face of the silicone protective ring.

8. The magnetic building block according to claim 1, wherein different patterns are distributed on the embedded paper.

9. The magnetic building block according to claim 1, wherein the embedded paper comprises cutouts for receiving the small magnets, the notches and the protruding chucks.

* * * * *